US007961169B2

(12) United States Patent
Oh

(10) Patent No.: US 7,961,169 B2
(45) Date of Patent: Jun. 14, 2011

(54) DISPLAY DEVICE HAVING A TIMING CONTROLLER

(75) Inventor: Jae-Ho Oh, Seoul (KR)

(73) Assignee: Samsung Electronics Co., Ltd. (KR)

( * ) Notice: Subject to any disclaimer, the term of this patent is extended or adjusted under 35 U.S.C. 154(b) by 824 days.

(21) Appl. No.: 11/655,715

(22) Filed: Jan. 18, 2007

(65) Prior Publication Data

US 2007/0164970 A1 Jul. 19, 2007

(30) Foreign Application Priority Data

Jan. 19, 2006 (KR) ..... 10-2006-0005950

(51) Int. Cl.
*G09G 3/36* (2006.01)

(52) U.S. Cl. ..... 345/99; 345/98

(58) Field of Classification Search ..... None
See application file for complete search history.

(56) References Cited

U.S. PATENT DOCUMENTS 7,382,345 B2 * 6/2008 Hong ..... 345/99
2003/0197672 A1 * 10/2003 Yun et al. ..... 345/99

* cited by examiner

*Primary Examiner* — Alexander Eisen
*Assistant Examiner* — Robin Mishler
(74) *Attorney, Agent, or Firm* — Innovation Counsel LLP

(57) ABSTRACT

A timing controller includes an interface controller that reads out a current identification code and current address information of the current identification code. A data comparator compares a previous identification code stored in a memory provided in the timing controller with the current identification code. If the current identification code is different from the previous identification code, the interface controller reads out current parameter data corresponding to the current identification code from the memory and a data processor processes image data by using the current parameter data. The timing controller recognizes the update state of the parameter data stored in the memory and processes the image data by using the updated parameter data.

26 Claims, 6 Drawing Sheets

Fig. 4

410

| 412 | 411 |
|---|---|
| Address | Data |
| 0x0000 | 0xFF |
| 0x0001 | 0xA1 |
| | |
| 0x00FF | 0xB0 |
| | |
| 0x1FBF | 0x01 |
| | |
| 0xFFFF | 0xFF |
| 0x1FFF | 0xFF |

A1

A2

DISPLAY DEVICE HAVING A TIMING CONTROLLER

CROSS-REFERENCE TO RELATED APPLICATION

This application relies for priority upon Korean Patent Application No. 2006-05950 filed on Jan. 19, 2006, the contents of which are herein incorporated by reference in its entirety.

FIELD OF THE INVENTION

The present invention relates to a display device having a timing controller.

DESCRIPTION OF THE RELATED ART

Liquid crystal display device includes a liquid crystal display panel having a matrix of pixels for displaying an image. Each of the pixels includes a gate line, a data line, a thin film transistor, and a liquid crystal capacitor. A data driver sends a data signal to the data line in response to a data control signal, and a gate driver sends a gate signal to the gate line in response to a gate control signal sent by a timing controller. In addition, the timing controller stores image data in a memory as the image data are received and then sends the image data to the data driver in a frame unit or a line unit. The timing controller processes the image data according to stored temperature or brightness parameter data.

However, if the parameter data stored in the memory have been updated or damaged, the conventional timing controller cannot recognize whether the parameter data stored in the memory is damaged.

SUMMARY OF THE INVENTION

The present invention provides a display device having a timing controller capable of recognizing a variation in stored parameter data. The timing controller periodically checks the identification code, thereby recognizing the update state of the parameter data stored in the memory so that the timing controller can process the image data by using the updated parameter data. In one aspect of the present invention, the timing controller compares the currently received identification code and current address information of the current identification code with previously stored identification code and outputs a first control signal when the previous identification code is different from the current identification code. The data processor processes the image data by using the current parameter data provided from the interface controller.

The timing controller includes an interface controller, a volatile memory, a data comparator and a data processor. The interface controller periodically reads out the currently received identification code and reads out current parameter data corresponding to the current identification code in response to a first control signal. The volatile memory includes a first storage area storing a previous identification code and a second storage area storing the current identification code. The data comparator compares the previous identification code with the current identification code so as to output the first control signal according to the result of the comparison to control the interface controller. The data processor processes the data signal using the current parameter data provided from the interface controller. According to still another aspect of the present invention, a display device includes a display unit, a gate driver, a data driver, a memory, a timing controller, and a digital interface. The display unit displays an image in response to a gate signal and a data signal, and the gate driver provides the gate signal to the display unit in response to a gate control signal. The data driver provides the data signal to the display unit in response to a data control signal.

BRIEF DESCRIPTION OF THE DRAWING

The above and other advantages of the present invention will become readily apparent from a reading of the ensuing description together with the drawing, in which:

FIG. 4 is a view illustrating an internal structure of a memory shown in FIG. 2;

DESCRIPTION OF THE EMBODIMENTS

Figure 1:
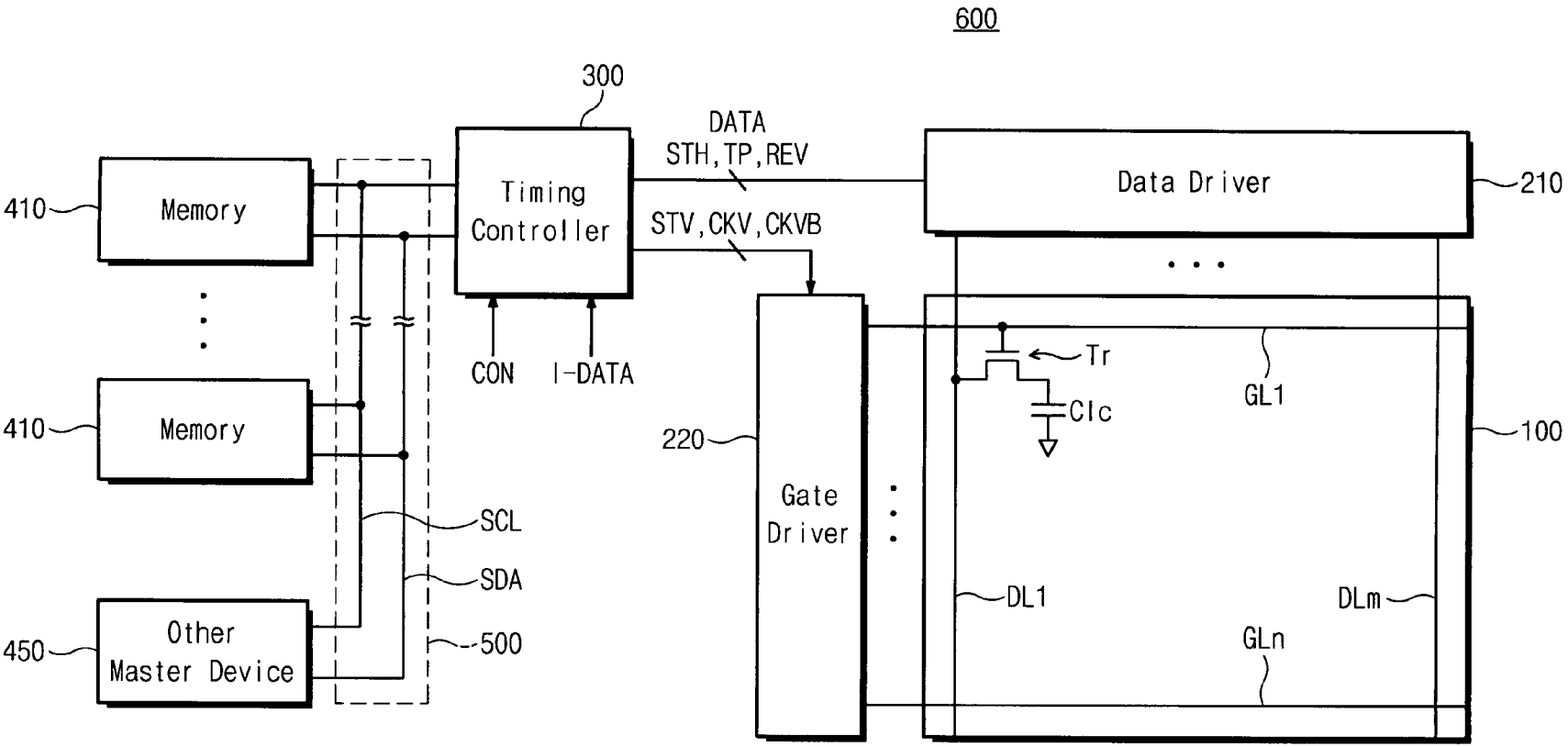
FIG. 1 is a block diagram showing an exemplary embodiment of a liquid crystal display device according the present invention.

FIG. 1 is a block diagram showing an exemplary embodiment of a liquid crystal display device according the present invention. Referring to FIG. 1, a liquid crystal display device 600 includes a liquid crystal display unit 100, a data driver 210, a gate driver 220, a timing controller 300, a plurality of memories 300, and a digital interface 500.

Liquid crystal display unit 100 includes a plurality of gate lines GL1 to GLn and data lines DL1 to DLm, wherein n and m are natural numbers equal to or higher than 2. The gate lines GL1 to GLn cross the data lines DL1 to DLm while being insulated from each other in such a manner that a plurality of pixel areas are defined by the gate lines GL1 to GLn and data lines DL1 to DLm. A pixel is formed in each pixel area.

First ends of the data lines DL1 to DLm are electrically connected to the data driver 210 to receive the data signal from the data driver 210. The gate lines GL1 to GLn are electrically connected to the gate driver 220 to sequentially receive the gate signal from the gate driver 220. Accordingly, the pixel is driven in response to the data signal and the gate signal.

The pixel includes a thin film transistor Tr and a liquid crystal capacitor Clc. For instance, the thin film transistor Tr includes a gate electrode electrically connected to the first gate line GL1 from among the gate lines GL1 to GLn, a source electrode electrically connected to the first data line DL1 from among the data lines DL1 to DLm, and a drain electrode electrically connected to liquid crystal capacitor Clc. Accordingly, the thin film transistor Tr outputs the data signal to the drain electrode in response to the gate signal.

A lower electrode of liquid crystal capacitor Clc is a pixel electrode, which is electrically connected to the drain electrode so as to receive the data signal, and an upper electrode of liquid crystal capacitor Clc is a common electrode to which a common voltage is applied. A liquid crystal layer is interposed between the pixel electrode and the common electrode as an insulating layer. Thus, liquid crystal capacitor Clc is charged according to the potential difference between the common voltage and the data signal.

The digital interface 500 interfaces between the timing controller 300 and the memories 410. According to an exemplary embodiment of the present invention, the digital interface 500 includes an inter integrated circuit ($I^2C$) interface. The $I^2C$ interface is a bidirectional 2-wire interface and includes a serial data line SDA for data communication and a serial clock line SCL, which controls and synchronizes data communication between devices.

The devices connected to the $I^2C$ interface are identified based on addresses dedicated to the devices, and each device can transmit or receive data. Data communication between the devices is achieved through a master-slave protocol scheme. The master initiates the data transmission and generates the clock signal. Remaining devices, other than the master, may serve as slaves which make data communication with the master. For instance, the $I^2C$ interface has a plurality of masters. The timing controller 300 is one of the masters and the memories 410 serve as slaves. In FIG. 1, reference numeral 450 represents another master.

The timing controller 300 is advantageously an integrated circuit chip that receives image data I-DATA and an external control signal CON. The timing controller 300 stores the image data I-DATA in one of the memories 410 in a frame unit and reads the image data I-DATA in a line unit so as to send the image data I-DATA to the data driver 210. In addition, the timing controller 300 converts the external control signal CON into the data control signal and the gate control signal so as to transmit the data control signal and the gate control signal to the data driver 210 and the gate driver 220, respectively.

Here, the data control signal includes a horizontal start signal STH used to start the operation of the data driver 210, an output indicating signal TP used to determine an output time of a data signal from the data driver 210, and a polarity reversal signal REV used to reverse polarity of the data signal. The gate control signal includes a vertical start signal STV used to start the operation of the gate driver 220 and first and second clock signals CKV and CKVB used to control the output of the gate driver 220.

The memories 410 include an EEPROM memory, which is a non-volatile memory. A data signal of 1-frame unit, which has been input through the digital interface 500, is stored in one of the memories 410. In addition, parameter data including information related to liquid crystal display unit 100, such as resolution, a size, brightness and a temperature of liquid crystal display unit 100, are stored in remaining memories 410 in a digital data from.

The timing controller 300 processes the data signal DATA by using the digital parameter data stored in the memories 410 and then sends the processed data signal to the data driver 220.

Hereinafter, detailed description will be made relative to the timing controller 300.

Figure 2:
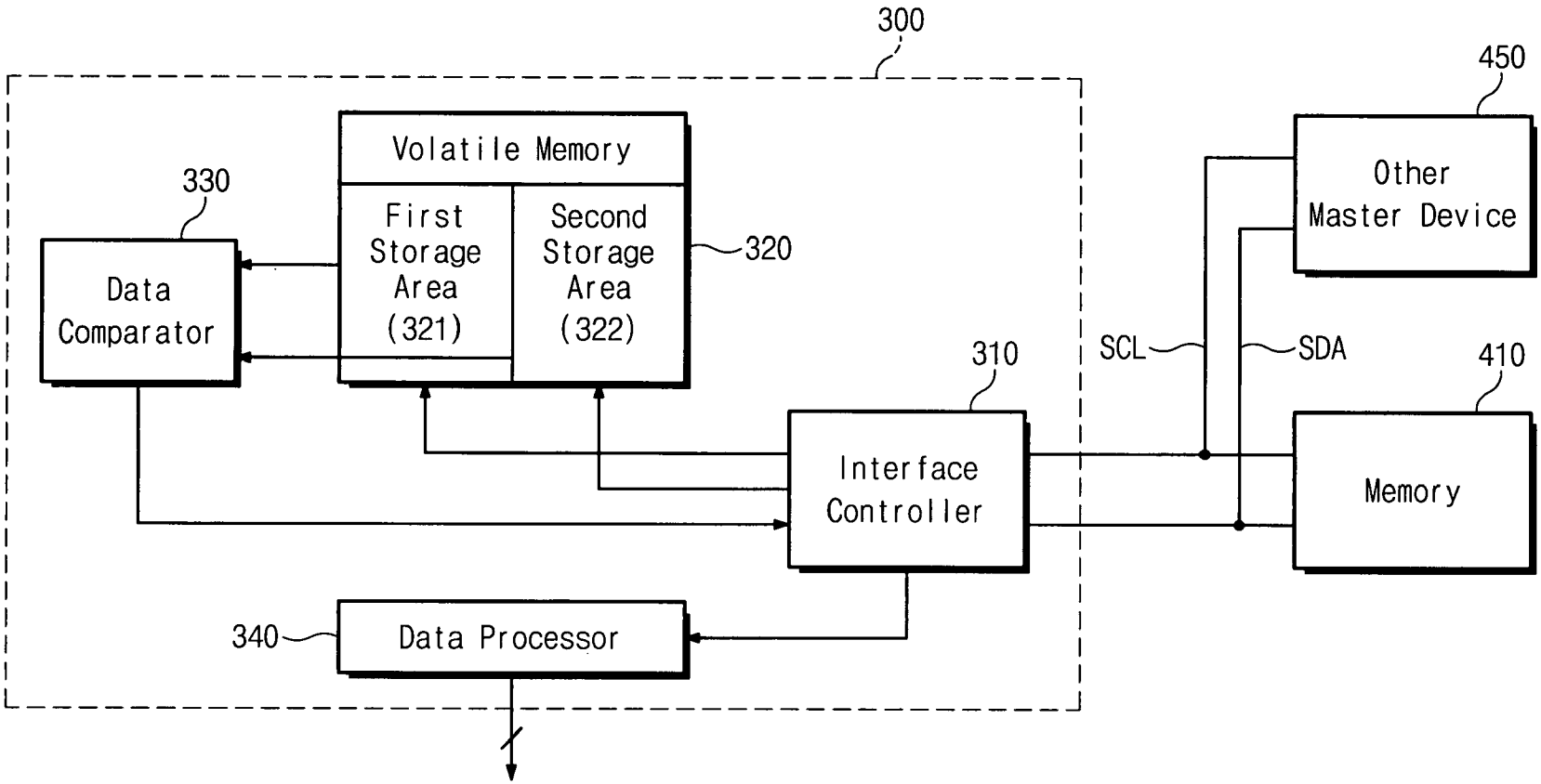
FIG. 2 is a block diagram showing an exemplary embodiment of an internal structure of a timing controller shown in FIG. 1.
Figure 3:
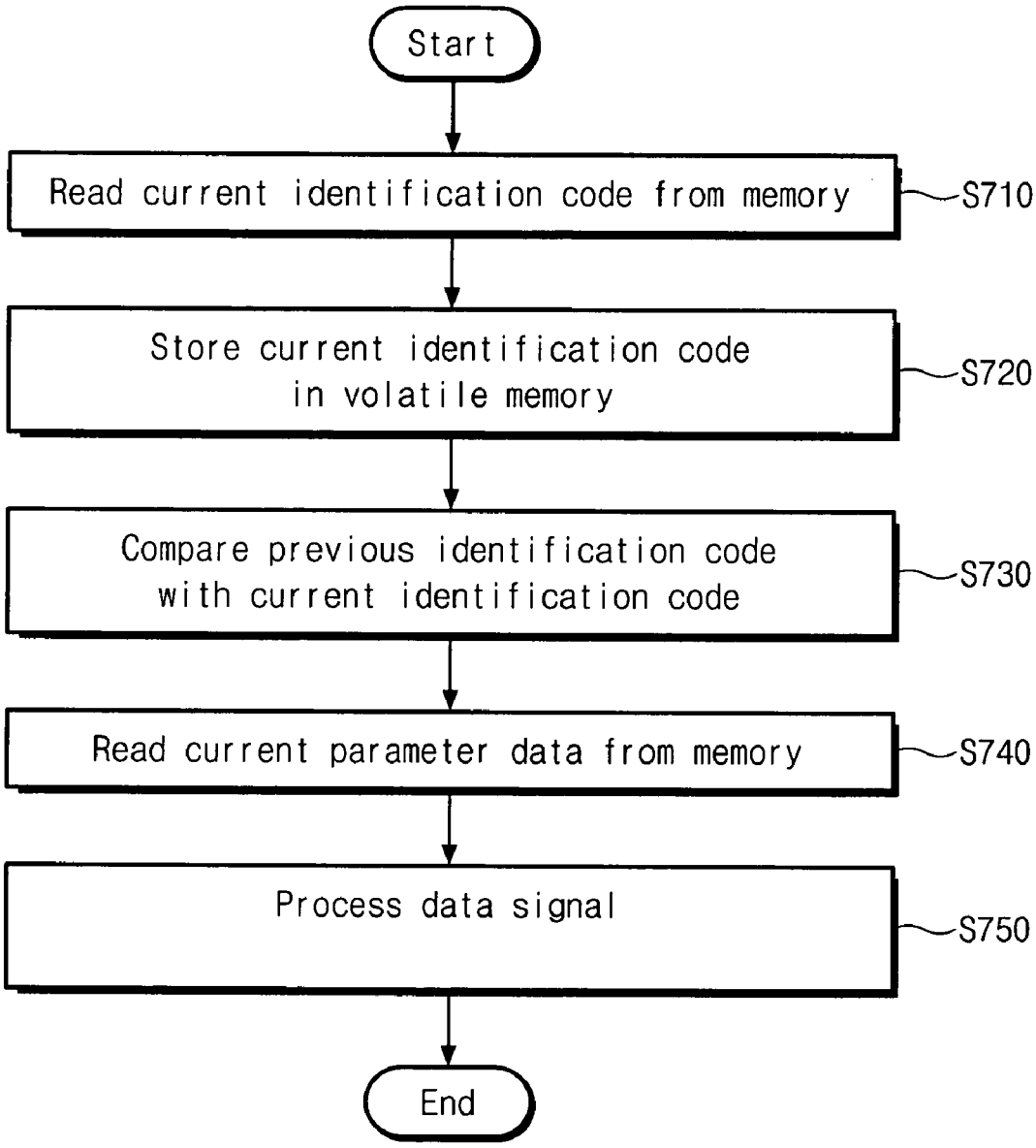
FIG. 3 is a flowchart illustrating a control procedure of the timing controller shown in FIG. 2.

FIG. 2 is a block diagram showing an exemplary embodiment of an internal structure of the timing controller shown in FIG. 1, and FIG. 3 is a flowchart illustrating the control procedure of the timing controller 300 shown in FIG. 2.

Referring to FIG. 2, the timing controller 300 includes an interface controller 310, a volatile memory 320, a data comparator 330 and a data processor 340.

As shown in FIGS. 2 and 3, the interface controller 310 periodically reads an identification code from the memories 410 (S710). A previous identification code previously read by the interface controller 310 is stored in a first storage area 321 of the volatile memory 320 provided in the timing controller 300, and a current identification code currently read by the interface controller 310 is stored in a second storage area 322 of the volatile memory 320 (S720).

The data comparator 330 compares the previous identification code with the current identification code (S730). If the comparing result represents that the previous identification code is different from the current identification code, the data comparator 330 outputs a control signal to the interface controller 310. Upon receiving the control signal from the data comparator 330, the interface controller 310 reads the current parameter data corresponding to the current identification code (S740).

Meanwhile, if the comparing result represents that the previous identification code is identical to the current identification code, the interface controller 310 repeatedly reads the current identification code from the memories 410 and stores the current identification code in the volatile memory 320.

The data processor 340 processes the data signal by using the current parameter data provided from the interface controller 310.

In the present embodiment, the identification code corresponds to a sum of the parameter data. Accordingly, if the parameter data stored in the memories 410 are updated, the identification code is also changed. The timing controller 300 determines variation of the identification code by periodically reading out the identification code, and then reads the updated current parameter data only when the identification code has been changed. As a result, the timing controller 300 can detect the variation of the parameter data stored in the memories 10 by using the identification code.

If an amount of the parameter data stored in the memories 410 increases, the identification code may not be identical to the sum of the parameter data stored in the memories 410. As another embodiment of the present invention, a plurality of identification codes may be provided, in which each identification code corresponds to the sum of parameter data in each region of the memories 410. In this case, the timing controller 300 selectively reads the parameter data corresponding to the changed identification code, thereby reducing a data reloading time.

As another embodiment of the present invention, the identification code may be obtained by adding dummy data to the sum of the parameter data. Accordingly, the parameter data can be prevented from being invented during data transmission between the timing controller 300 and the memories 410. As a result, the parameter data can be concealed.

FIG. 4 is a view illustrating the internal structure of the memory shown in FIG. 2.

Referring to FIG. 4, the memory 410 includes a data storage area 411 storing data and an address storage area 412 storing address information of the data. The data storage area 411 includes a first storage area A1 where address information of the data is stored and a second storage area A2 where the identification code is stored.

In the exemplary embodiment of the present invention, the identification code includes 256 parameter data and is stored in the form of a 16-bit code. When the parameter data are stored only in a predetermined portion of the first storage area A1 corresponding to 80% of the first storage area A1 having a size of 64 kbit, the identification code occupies a storage space of 64 bytes (32×2-byte) in the first storage area A1. That is, the identification code is stored in the storage space corresponding to 1% of the first storage area A1.

In this manner, if the identification code is stored by combining the 256 parameter codes, the timing controller 300 (see, FIG. 2) can detect variation of the parameter data by using the identification code and can reduce the data reloading time by selectively reading out the parameter data corresponding to the changed portion of the identification code.

Figure 5:
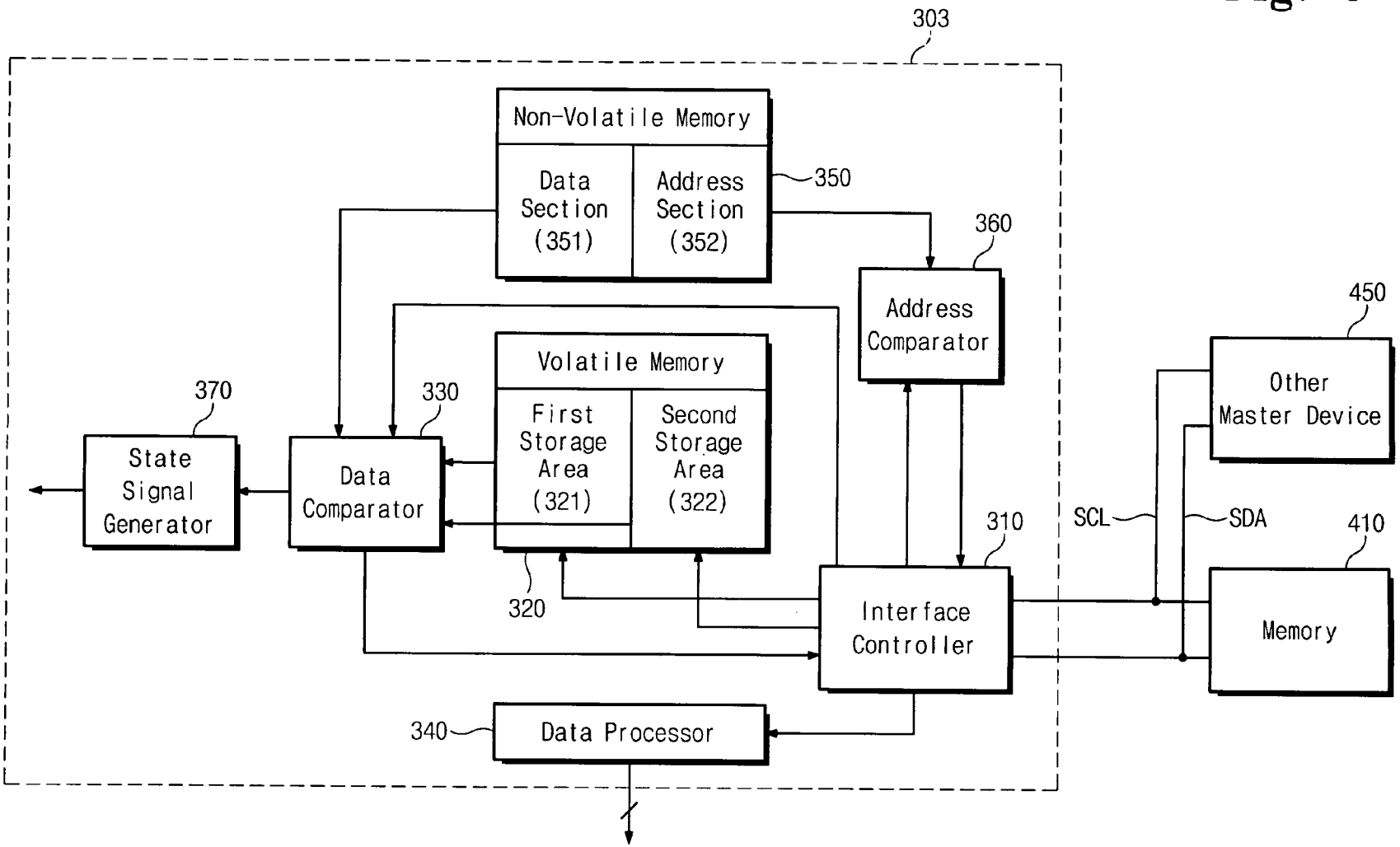
FIG. 5 is a block diagram illustrating another exemplary embodiment of an internal structure of a timing controller according to the present invention.
Figure 6:
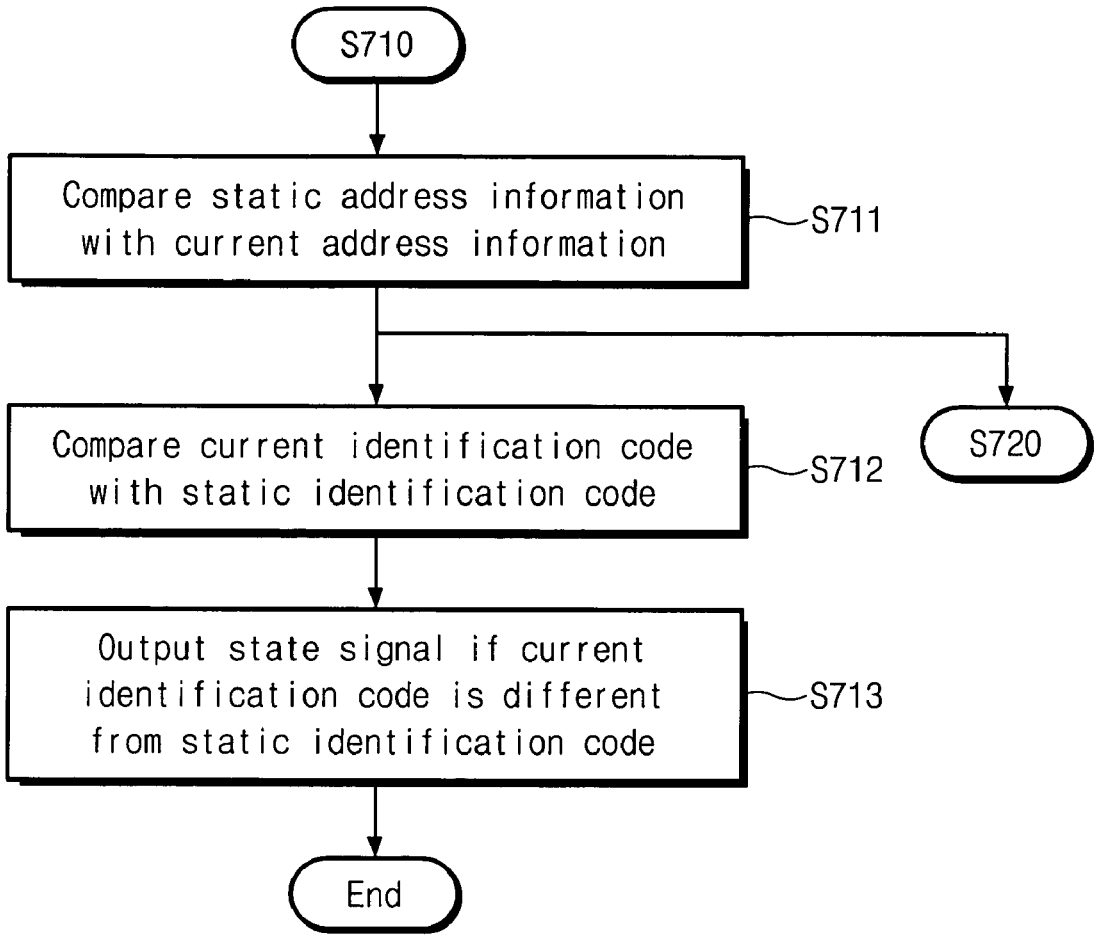
FIG. 6 is a flowchart illustrating a control procedure of the timing controller shown in FIG. 5.

FIG. 5 is a block diagram showing another exemplary embodiment of an internal structure of a timing controller according to the present invention, and FIG. 6 is a flowchart illustrating a control procedure of the timing controller shown in FIG. 5. In FIG. 5, the same reference numerals denote the same elements shown in FIG. 2 and thus detailed description thereof will be omitted in order to avoid redundancy.

Referring to FIG. 5, the timing controller 303 includes an interface controller 310, a volatile memory 320, a data comparator 330, a data processor 340, a non-volatile memory 350, an address comparator 360, and a state signal generator 370.

The non-volatile memory 350 is divided into a data section 351 and an address section 352. A static identification code corresponding to the sum of static parameter data stored in the memory 410 is stored in the data section 351, and address information of the static identification code is stored in the address section 352. Here, the static parameter data refer to non-variable data from among parameter data stored in the memory 410.

As shown in FIGS. 5 and 6, the interface controller 310 periodically reads the current identification code from the memory 410 (S710).

The address comparator 360 compares the static address information stored in the non-volatile memory 350 with the current address information of the current identification code (S711).

If the comparing result represents that the static address information is identical to the current address information, the address comparator 310 outputs a second control signal to the interface controller 310. The interface controller 310 sends the current identification code to the data comparator 330 in response to the second control signal, so that the data comparator 330 compares the current identification code with the static identification code (S712). In contrast, if the comparing result represents that the static address information is different from the current address information, the current identification code is stored in the volatile memory 320 (S720).

The data comparator 330 outputs a third control signal according to the comparing result between the static address information and the current address information. In addition, the state signal generator 370 outputs a state signal, which represents the state of the current parameter data, in response to the third control signal (S713). In particular, if the static address information is different from the current address information, the state signal generator 370 outputs a state signal representing damage of the current parameter data. If the static address information is identical to the current address information, the state signal generator 370 outputs a state signal representing the normal state of the current parameter data.

Thus, the interface controller 310 does not receive the current parameter data if the current parameter data are damaged, but send previously stored static parameter data to the data processor 340. Accordingly, the timing controller 303 can process the data signal by using the static parameter data stored therein, even if the static parameter data stored in the memory 410 are damaged. As a result, the timing controller 303 can prevent the data signal from being abnormally processed due to the damaged parameter data.

As described above, the timing controller periodically checks the identification code corresponding to the sum of the parameter data, so that the timing controller can detect the update of the parameter data stored in the memory and can process the image data by using the updated parameter data.

In addition, the timing controller detects damage of the static parameter data by using the identification code and forms the identification code by adding dummy data to the sum of the parameter data, so that the parameter data can be concealed.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method of driving a timing controller for a display unit displaying an image, the method comprising:

reading from an external memory outside the timing controller a currently supplied identification code and its current address information;

comparing an identification code previously stored in an internal memory provided in the timing controller with the currently supplied identification code;

reading out current parameter data corresponding to the currently supplied identification code from the external memory when the previously identification code is different from the currently supplied identification code;

processing a currently supplied image data using the current parameter data, and providing the processed image data to the display unit, wherein the current parameter data include information related to the display unit.

2. The method of claim 1, further comprising:

repeatedly reading and comparing the current identification code with the previous identification code when the current identification code is identical to the previous identification code.

3. The method of claim 1, wherein the current identification code corresponds to a sum of the current parameter data.

4. The method of claim 1, prior to comparing the previous identification code with the current identification code, further comprising:

comparing the current address information of the current identification code with static address information of a previously stored static identification code;

comparing the previously stored static identification code with the current identification code by comparing the current address information and the static address information; and outputting a state signal representing damaged current parameter data corresponding to the current identification code by comparing the previously stored static identification code and the current identification code.

5. The method of claim 4, further comprising:

comparing the static identification code with the current identification code if the current address information is identical to the static address information; and comparing the current identification code with the previous identification code if the current address information is different from the static address information.

6. The method of claim 4, further comprising:

outputting a first state signal representing a normal state of the current parameter data if the static identification code is identical to the current identification code; and outputting a second state signal representing the damage of the current parameter data if the static identification code is different from the current identification code.

7. The method of claim 4, wherein the current identification code corresponds to a sum of the current parameter data and the static identification code corresponds to a sum of the static parameter data.

8. The method of claim 1, wherein the current identification code is obtained by adding dummy data to a sum of the current parameter data.

9. A timing controller for a display unit displaying an image, the timing controller comprising:

an interface controller periodically reading out a current identification code and address information of the current identification code from an external memory, and reading out current parameter data corresponding to the current identification code from the external memory in response to a first control signal;

a first storage area storing a previous identification code and a second storage area storing the current identification code;

a data comparator comparing the previous identification code with the current identification code so as to supply the first control signal to the interface controller when the previous identification code is different from the current identification code; and a data processor receiving image data and processing the image data signal by using the current parameter data provided from the interface controller, wherein the current parameter data include information related to the display unit receiving the processed image data to display an image.

10. The timing controller of claim 9, wherein the first storage includes a volatile memory.

11. The timing controller of claim 9, further comprising:

a second storage storing a static identification code and address information of the static identification code; and an address comparator comparing the address information of the static identification code stored in the second storage with the address information of the current identification code and outputting a second control signal to the interface controller if the address information of the static identification code is identical to the address information of the current identification code.

12. The timing controller of claim 11, wherein the interface controller provides the current identification code to the data comparator in response to the second control signal.

13. The timing controller of claim 12, wherein the data comparator compares the current identification code with the static identification code and outputs a third control signal if the static identification code is different from the current identification code.

14. The timing controller of claim 13, further comprising a state signal generator which outputs a state signal representing damage of the current parameter data in response to the third control signal.

15. The timing controller of claim 11, wherein the second storage includes a non-volatile memory.

16. The timing controller of claim 9, wherein the current identification code corresponds to a sum of the current parameter data.

17. The method of claim 1, wherein the current parameter data comprises a current brightness information and a current temperature information related to the display unit receiving the data signal to display an image.

18. The timing controller of claim 9, wherein the current parameter data comprises a current brightness information and a current temperature information related to the display unit receiving the data signal to display an image.

19. A display device comprising:

a display unit displaying an image in response to a gate signal and a data signal;

a gate driver providing the gate signal to the display unit in response to a gate control signal;

a data driver converting image data into the data signal and providing the data signal to the display unit in response to a data control signal;

an external memory including a first storage area storing address information therein and a second storage area storing parameter data including information related to the display unit and a identification code therein;

a timing controller providing the gate and data control signals to the gate and data drivers in response to external control signals, respectively, and processing the image data by using the parameter data stored in the external memory so as to transmit the processed image data to the data driver, wherein the external memory is outside the timing controller; and a digital interface interfacing between the external memory and the timing controller, the timing controller comprising:

an interface controller periodically reading out a current identification code and address information of the current identification code from the external memory, and reading out current parameter data corresponding to the current identification code from the external memory in response to a first control signal;

a volatile internal memory including a first storage area storing a previous identification code and a second storage area storing the current identification code;

a data comparator comparing the previous identification code with the current identification code so as to supply the first control signal to the interface controller when the previous identification code is different from the current identification code; and a data processor processing the image data by using the current parameter data provided from the interface controller and providing the processed image data to the data driver.

20. The display device of claim 19, wherein the timing controller further comprises:

a non-volatile memory storing a static identification code and address information of the static identification code; and an address comparator comparing the address information of the static identification code stored in the non-volatile memory with the address information of the current identification code and outputting a second control signal to the interface controller if the address information of the static identification code is identical to the address information of the current identification code.

21. The display device of claim 20, wherein the interface controller provides the current identification code to the data comparator in response to the second control signal, and the data comparator compares the current identification code with the static identification code and outputs a third control signal if the static identification code is different from the current identification code.

22. The display device of claim 21, the timing controller further includes a state signal generator which outputs a state signal representing damage of the current parameter data in response to the third control signal.

23. The display device of claim 19, wherein the current identification code corresponds to a sum of the current parameter data.

24. The display device of claim 19, wherein the external memory comprises an electrically-erasable programmable read-only memory (EEPROM).

25. The display device of claim 19, wherein the digital interface comprises an inter-integrated circuit ($I^2C$) interface.

26. The display device of claim 19, wherein the current parameter data comprises a current brightness information and a current temperature information related to the display unit.

* * * * *